US007800475B2

(12) United States Patent
Mizutani et al.

(10) Patent No.: US 7,800,475 B2
(45) Date of Patent: Sep. 21, 2010

(54) NON-CONTACT SIGNAL TRANSMISSION APPARATUS

(75) Inventors: Ryota Mizutani, Kanagawa (JP); Yasuaki Konishi, Kanagawa (JP); Kiyoshi Iida, Kanagawa (JP); Hiroyuki Funo, Kanagawa (JP); Masao Watanabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 561 days.

(21) Appl. No.: 11/902,284

(22) Filed: Sep. 20, 2007

(65) Prior Publication Data

US 2008/0224543 A1 Sep. 18, 2008

(30) Foreign Application Priority Data

Mar. 16, 2007 (JP) ..... 2007-068467

(51) Int. Cl.
*H01F 21/06* (2006.01)
*H01F 27/24* (2006.01)

(52) U.S. Cl. ..... 336/130; 336/212; 336/132

(58) Field of Classification Search ..... 336/130–132, 336/134, 212

See application file for complete search history.

(56) References Cited

U.S. PATENT DOCUMENTS

| | | | | |
|---|---|---|---|---|
| 4,837,556 | A * | 6/1989 | Matsushita et al. | 369/47.1 |
| 5,747,894 | A * | 5/1998 | Hirai et al. | 307/104 |
| 5,909,100 | A * | 6/1999 | Watanabe et al. | 320/108 |
| 6,388,548 | B1 * | 5/2002 | Saito et al. | 336/90 |
| 6,897,756 | B2 * | 5/2005 | Haisch | 336/130 |
| 7,106,163 | B2 * | 9/2006 | Jin et al. | 336/233 |
| 7,663,462 | B2 * | 2/2010 | Makuth et al. | 336/130 |

FOREIGN PATENT DOCUMENTS

| | | | |
|---|---|---|---|
| JP | 11354348 | A * | 12/1999 |
| JP | A 11-354348 | | 12/1999 |
| JP | A 2001-309013 | | 11/2001 |

* cited by examiner

*Primary Examiner*—Anh T Mai
(74) *Attorney, Agent, or Firm*—Oliff & Berridge PLC

(57) ABSTRACT

A non-contact signal transmission apparatus transmits electric power and a signal in a non-contact manner via magnetic induction. The apparatus includes: a pair of annular electric power cores provided in opposing relationship to each other; a pair of electric power coils respectively provided in an annular form at one of the pair of electric power cores; and a pair of signal coils respectively provided in an annular form inside one of the pair of electric power cores. Relative permeability inside and around the signal coils is lower than relative permeability of the electric power cores.

12 Claims, 7 Drawing Sheets

NON-CONTACT SIGNAL TRANSMISSION APPARATUS

CROSS-REFERENCE TO RELATED APPLICATION

This application claims priority under 35 USC 119 from Japanese Patent Application No. 2007-68467 filed Mar. 16, 2007.

BACKGROUND

1. Technical Field

The present invention relates to a non-contact signal transmission apparatus.

2. Related Art

Conventionally, both electric power and data are transmitted simultaneously by electromagnetic induction. However, due to the function of the electromagnetic induction, interference occasionally occurs between an electric power coil for transmitting electric power and a signal coil for transmitting data, which leads to a decrease in transmission reliability.

In this regard, a technique is proposed that suppresses the interference between the electric power coil and the data coil so as to heighten the transmission reliability.

SUMMARY

A first aspect of the invention provides a non-contact signal transmission apparatus that transmits electric power and a signal in a non-contact manner via electromagnetic induction, the apparatus including: a pair of annular electric power cores provided in opposing relationship to each other; a pair of electric power coils respectively provided in an annular form in one of the pair of electric power cores; and a pair of signal coils respectively provided in an annular form inside one of the pair of electric power cores, wherein relative permeability inside and around the signal coils is lower than relative permeability of the electric power cores.

BRIEF DESCRIPTION OF THE DRAWINGS

Exemplary embodiments of the present invention will be described in detail based on the following figures, in which.

DETAILED DESCRIPTION

An exemplary embodiment of the present invention will be described below with reference to the drawings.

Figure 1:
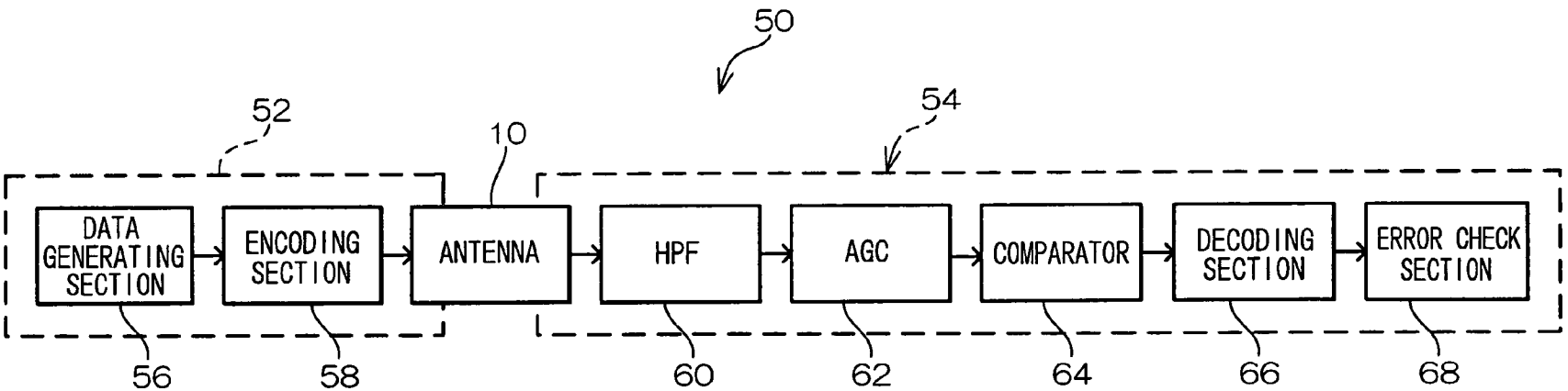
FIG. 1 illustrates a schematic structure of a transmitting/receiving circuit that transmits/receives data, wherein an antenna is provided.

A transmitting/receiving circuit 50 which transmits/receives data using an antenna 10 will be described with reference to FIG. 1.

The transmitting/receiving circuit 50 includes a transmitting circuit 52 that transmits data and electric power and a receiving circuit 54 that receives data and electric power.

The antenna 10 is mounted at a position associated with the transmitting circuit 52 and the receiving circuit 54.

Figure 2A:
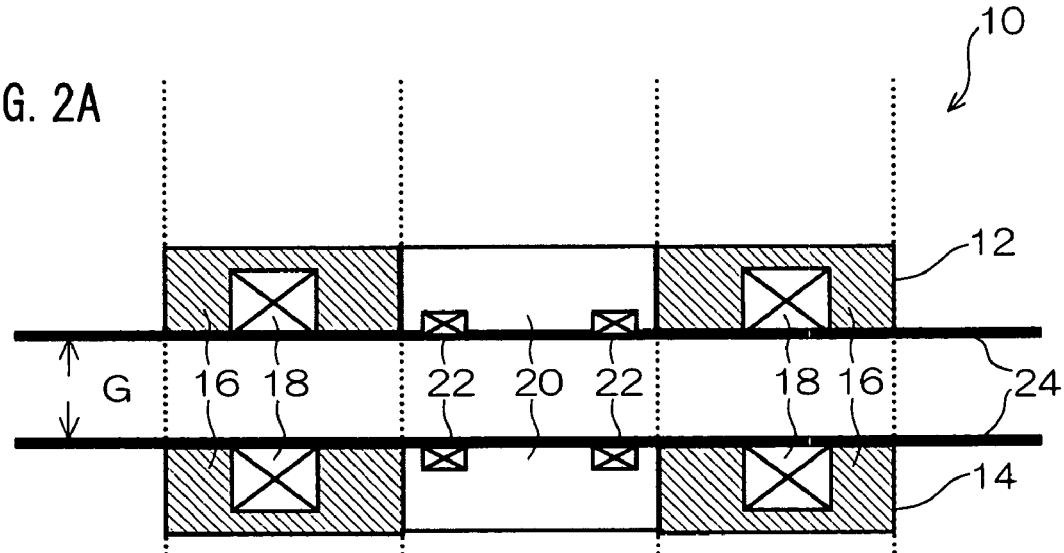
FIGS. 2A and 2B illustrates a schematic structure of the antenna.
Figure 2B:
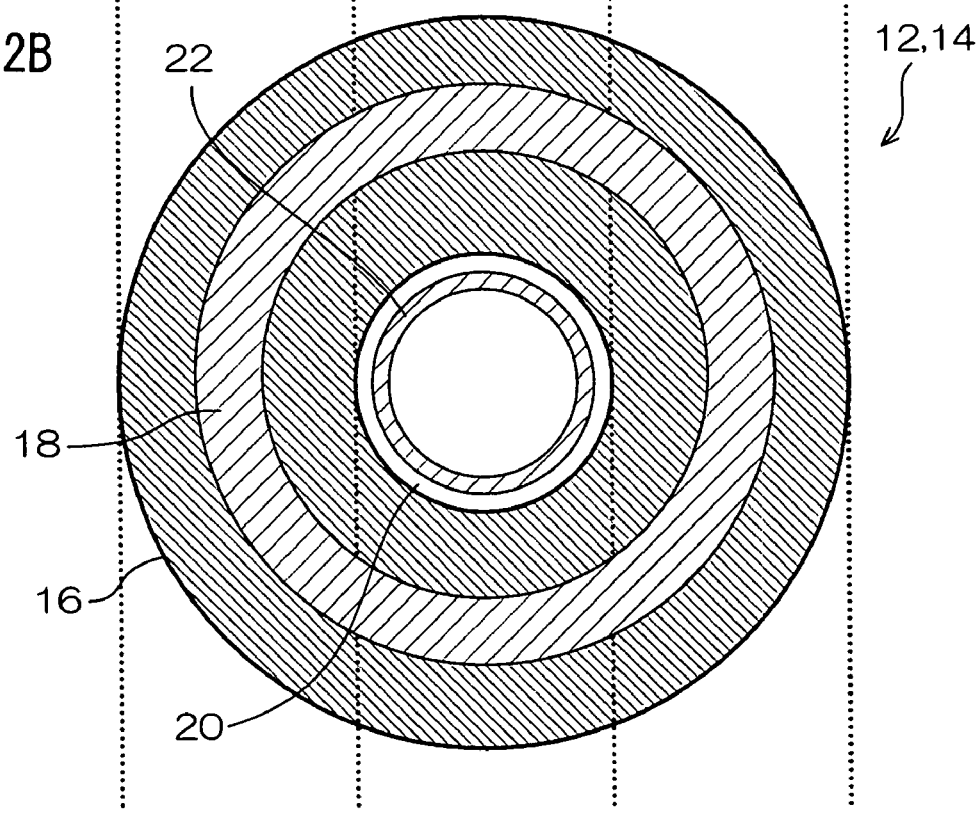

As shown in FIGS. 2A and 2B, the antenna 10 that transmits both electric power and data are configured such that a transmission side core 12 and a reception side core 14 are disposed in opposing relationship to each other with a predetermined gap G therebetween. In the antenna 10, the transmission side core 12 is mounted to the transmitting circuit 52, and the reception side core 14 is mounted to the receiving circuit 54. The antenna 10 electrically connects the transmitting circuit 52 and the receiving circuit 54 via electromagnetic induction, and transmits both electric power and data between the transmitting circuit 52 and the receiving circuit 54 in a non-contact manner.

The transmitting circuit 52 includes a data generating section 56 that generates data to be transmitted, and an encoding section 58 that encodes the data generated by the data generating section 56. The encoding section 58 transmits the encoded information to the transmission side core 12 mounted to the transmitting circuit 52.

Examples of data encoding by the encoding section 58 are described with reference to FIGS. 3A to 3C.

Figure 3A:
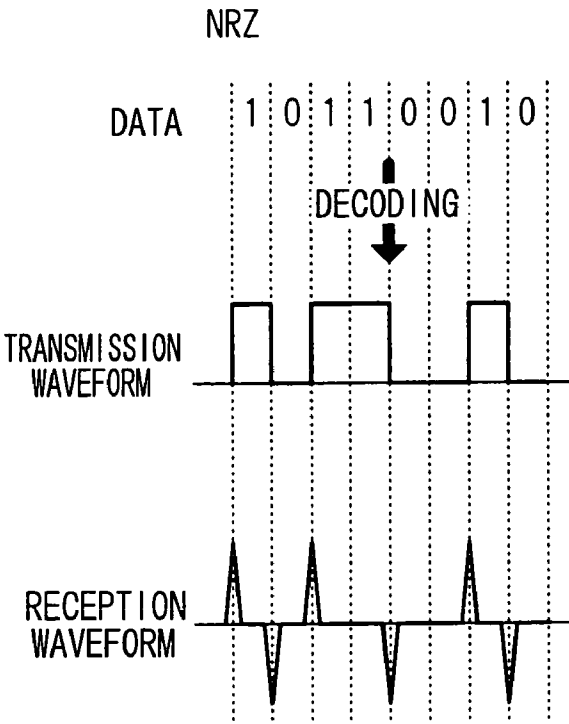
FIGS. 3A to 3C illustrate examples of data encoding.

FIG. 3A illustrates a voltage waveform (transmission waveform) at the transmitting circuit 52 side when data is encoded using an NRZ encoding system.

In the NRZ encoding system, a state "1" of data is allocated to high voltage level, and a state "0" of data is allocated to low voltage level.

Figure 3B:
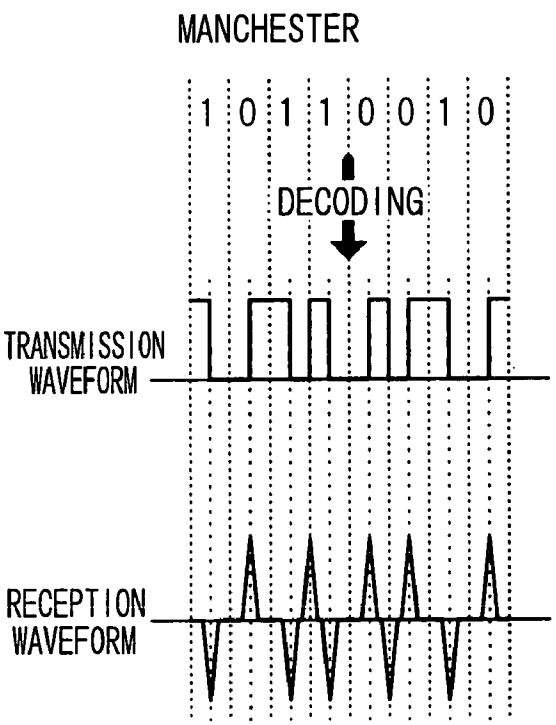

FIG. 3B illustrates a voltage waveform (transmission waveform) on the side of the transmitting circuit 52 in the case where data are encoded using a Manchester encoding system.

In the Manchester encoding system, a state "1" of data is allocated to transition from high voltage level to low voltage level. A state "0" of data is allocated to transition from low voltage level to high voltage level.

Figure 3C:
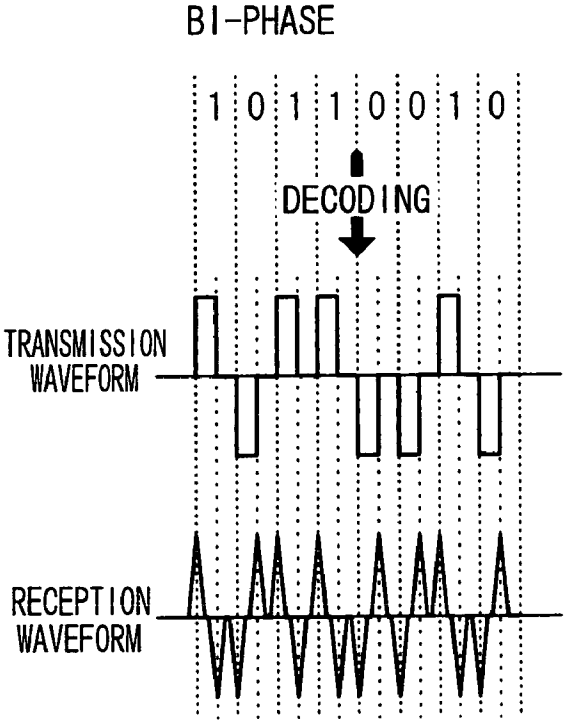

FIG. 3C illustrates a voltage waveform (transmission waveform) on the side of the transmitting circuit 52 when data is encoded using a bi-phase encoding system.

In the bi-phase encoding system, a state "1" of data is allocated to short-period transition to a voltage level higher than a standard level. A state "0" of data is allocated to short-period transition to a voltage level lower than the standard level.

Transmission using the Manchester encoding system or the bi-phase encoding system is more advantageous than transmission using the NRZ encoding system because noise resistance is high. However, transmission using the Manchester encoding system or the bi-phase encoding system requires a transmission clock two times as high as transmission using the NRZ encoding system.

The receiving circuit 54 includes: a high-pass filter 60 that removes a low-frequency noise component from the voltage value and takes out a high-frequency component of the voltage value; an automatic gain controller 62 that controls the level of the voltage value; a comparator 64 that determines a threshold of the level of the voltage value and digitizes the voltage value; a decoding section 66 that carries out decoding using a logic circuit; and an error check section 68 that checks errors of received data by parity check or check using a CRC system.

A voltage waveform (reception waveform) after the high-frequency component is taken out by the high-pass filter 60 is a differential form of the transmission waveform as shown in FIGS. 3A to 3C.

When the automatic gain controller 62 controls the level of a voltage value to be input into the decoding section 66, the comparator 64 may not be provided.

An outline of opposing surfaces of the transmission side core 12 and the reception side core 14 is described below with reference to FIG. 2B.

Since the reception side core 14 has the same structure as that of the transmission side core 12, only the transmission side core 12 is described, and description of the reception side core 14 is omitted.

The transmission side core 12 includes: an annular electric power core 16 that is hollow at a center portion and formed with an inner annular groove; an electric power coil 18 that is formed by a conductive wire wound around in the inner annular groove of the electric power core 16 to transmit electric power; a data core 20 disposed at the center portion of the electric power core 16; and a data coil 22 that is formed by a conductive wire wound around on the data core 20 to transmit data.

The electric core 16 is made of a material having relative permeability of 100 to 1000 so as to achieve enhanced electric power transmission efficiency. In this exemplary embodiment, ferrite, which is a ferromagnetic material, is used as the material of the electric power core 16.

The data core 20 is configured such that that the relative permeability thereof is at least lower than the relative permeability of the electric power core 16. Thus, an interference of the electric power coil 18 with the data coil 22 can be suppressed. A ratio of the relative permeability of the data core 20 to the relative permeability of the electric power core 16 is desirably set so as to be less than 1/10. This setting enables the configuration of the circuit, to which the antenna 10 is applied, to be simplified, while at the same time decreasing the rate of occurrence of transmission error. In this exemplary embodiment, the data core 20 is made of a polymer system material, which is a low-permeability material.

It is possible that without the data core being provided, the data coil 22 may be provided on a base material of the center portion of the electric power core 16 by forming a conductive wire pattern by an etching process.

Next, a relationship between inductance of the coil and voltage waveform will be illustrated, and based on the relationship, a relationship between frequency of data signal and upper limit value of the inductance of the data coil 22 that enables a high reliability of data transmission will be illustrated.

Figures 4A, 4B, 4C:
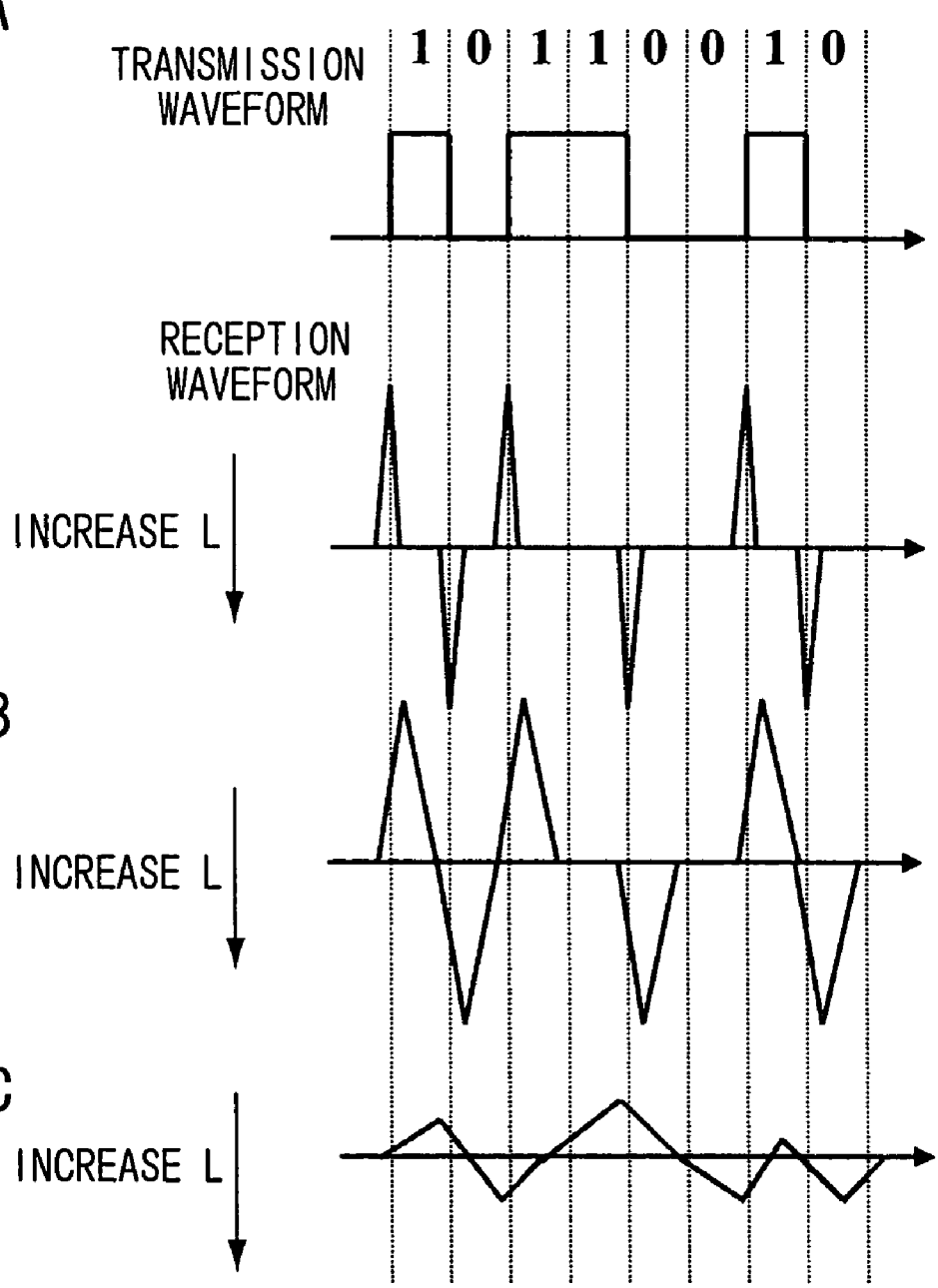
FIGS. 4A to 4C illustrate relationships between inductance and reception waveform.

As shown in FIG. 4A, a voltage waveform (reception waveform) on the receiving circuit 54 side, whose high-frequency component has been taken out by the high-pass filter 60, is a differential version of a voltage waveform on the transmitting circuit 52 side.

The coils act as a low-pass filter of LC. Thus, if the inductance of the coils increases, the high-frequency component attenuates. FIGS. 4B and 4C illustrate examples of a change in the reception waveform in the case where the inductance is changed. If the inductance is increased, rising and falling of a pulse of the reception waveform are delayed, and a half bandwidth of the pulse is increased.

As shown in FIG. 4C, if adjacent pulses are superposed upon each other due to the increase in the half bandwidth of the pulse, the transmission reliability is decreased. In other words, when the half bandwidth of the pulse is narrower than an interval between the adjacent pulses, high-reliability transmission can be performed. It is known that if the inductance becomes x times greater, the time constant becomes x times greater, and if the time constant becomes x times greater, the half bandwidth of the pulse becomes x times greater. That is to say, by setting the inductance appropriately, the half bandwidth of the pulse can be made to be narrower than the interval between the adjacent pulses, so that the transmission can be carried out with high reliability.

Figure 5:
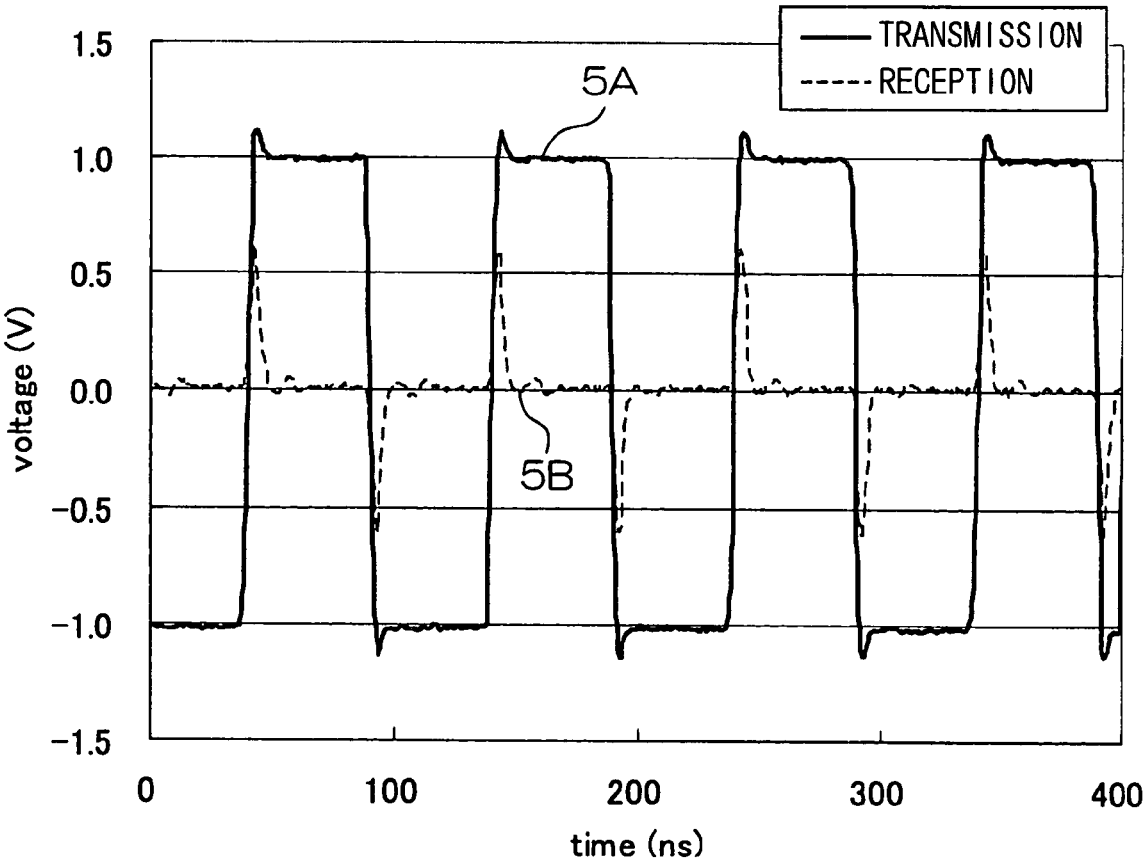
FIG. 5 illustrates a transmission waveform and a reception waveform obtained by an experiment in which data are transmitted/received between a pair of opposed coils.

FIG. 5 illustrates a voltage waveform 5A on the transmitting circuit 52 side and a voltage waveform (reception waveform) 5B on the receiving circuit 54 side obtained by an experiment in which data transmission is carried out using a pair of opposed coils.

The coils used in the experiment are 24 mm in diameter and a single turn, and a medium inside and around the coils is 1 (unity) in relative permeability. The inductance of the coils is 50 nH, and the frequency of the data signal is 10 MHz. The distance between the opposed coils is substantially 0 mm.

As shown in FIG. 5, when the data signal having a frequency of 10 MHz is transmitted by the coils having an inductance of 50 nH, the half bandwidth of the pulse of the reception waveform becomes about 1/10 of the interval between the adjacent pulses. As described above, when the half bandwidth of the pulse is narrower than the interval between the adjacent pulses, the transmission can be carried out with high reliability. Thus, it can be presumed that by making the half bandwidth of the pulse to be 10 or less times as wide as the width shown in FIG. 5, the transmission can be carried out with high reliability. Further, it is known that if the inductance becomes $x^2$ times greater, the half bandwidth of the pulse becomes x-times. Consequently, it is noted that the inductance may be set to be 100 ($=10^2$) or less times of 50 nH so that the half bandwidth of the pulse becomes 10 times or less. That is to say, by setting the inductance of the coils to be 5000 nH or less, it is possible to transmit the data signal having a frequency of 10 MHz with high reliability.

Figure 6:
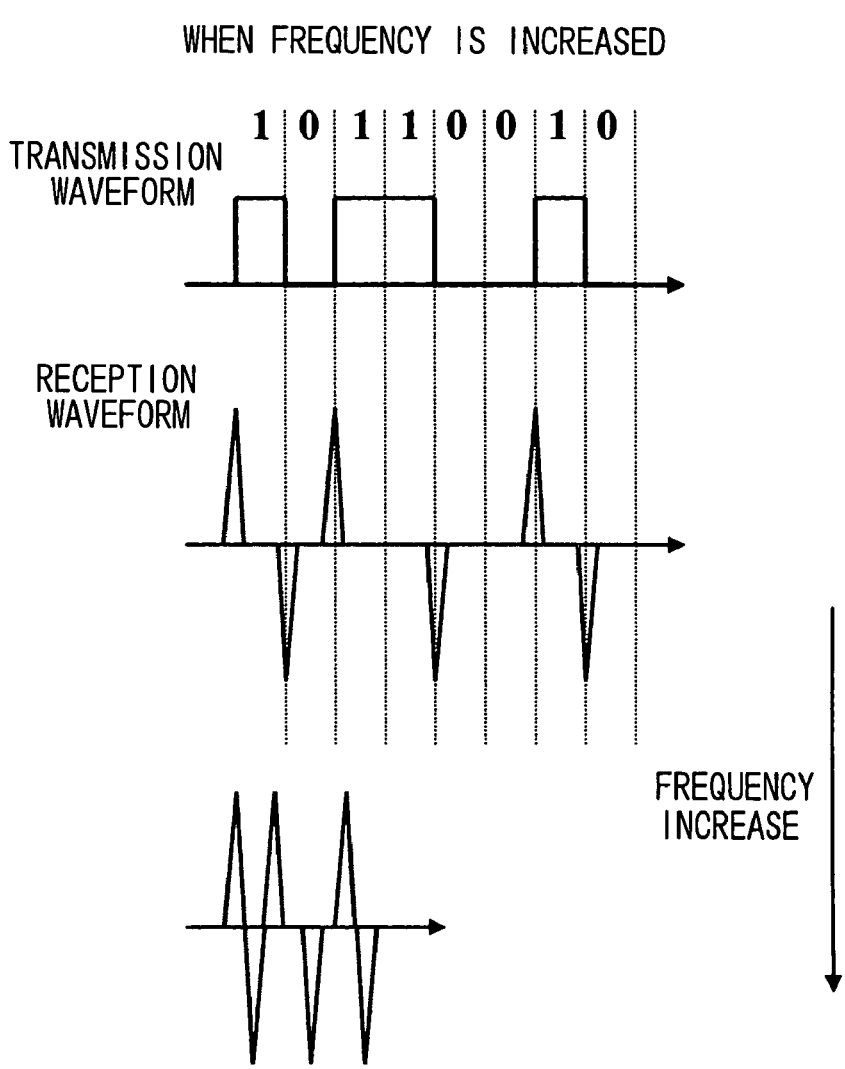
FIG. 6 illustrates relationships between a data signal frequency and a pulse interval of a reception waveform.

On the other hand, as shown in FIG. 6, as the frequency of the data signal is increased, the pulse interval of the reception waveform becomes narrower. From this, it can be seen that in order to carry out high-reliability transmission, it is necessary to set the inductance of the coils to a lower value according to the frequency of the data signal.

A relationship between the frequency of the data signal and an upper limit value of the inductance of the coils for high-reliability transmission is derived from what is described above. The derived relationship is represented by the following formula (2).

$$L<L_{max}=50/f \qquad \text{formula (2)}$$

where

L: the inductance of the coils (unit: μH)

$L_{max}$: the upper limit value of the inductance (unit: μH)

f: the frequency of the data signal (unit: MHz)

When the inductance is set according to the formula (2), data can be transmitted at a high speed and with high reliability.

Since the inductance and the relative permeability of the coils are proportional to each other, the range of the relative permeability of the one-turn coils having a diameter of 24 mm used in the experiment can be obtained. Table 1 shows an example of the relationship among the frequency of the data signal, the upper limit value of the inductance of the coils and the range of the optimal relative permeability.

TABLE 1

| Frequency | Upper limit of inductance | Range of optimal relative permeability (in the case of the one-turn coils with diameter of 24 mm) |
|---|---|---|
| 1 MHz | 50μ | <1000 |
| 10 MHz | 5μ | <100 |
| 100 MHz | 500 nH | <10 |
| 1 GHz | 50 nH | <1 |

The inductance of one-turn coils can be obtained by substituting numerical values in the following formula (3). According to the formula (3), the range of the optimal permeability of a coil of any size can be derived.

$$L=4\pi\mu_r R(2.303\log_{10}(16R/d)-a)\times10^{-4} \quad \text{Formula (3)}$$

where

L: the inductance of the coils (unit: μH)

R: radius of the coils (unit: mm)

d: diameter of conductive wire (unit: mm)

$\mu_r$: relative permeability a: constant

Figure 7:
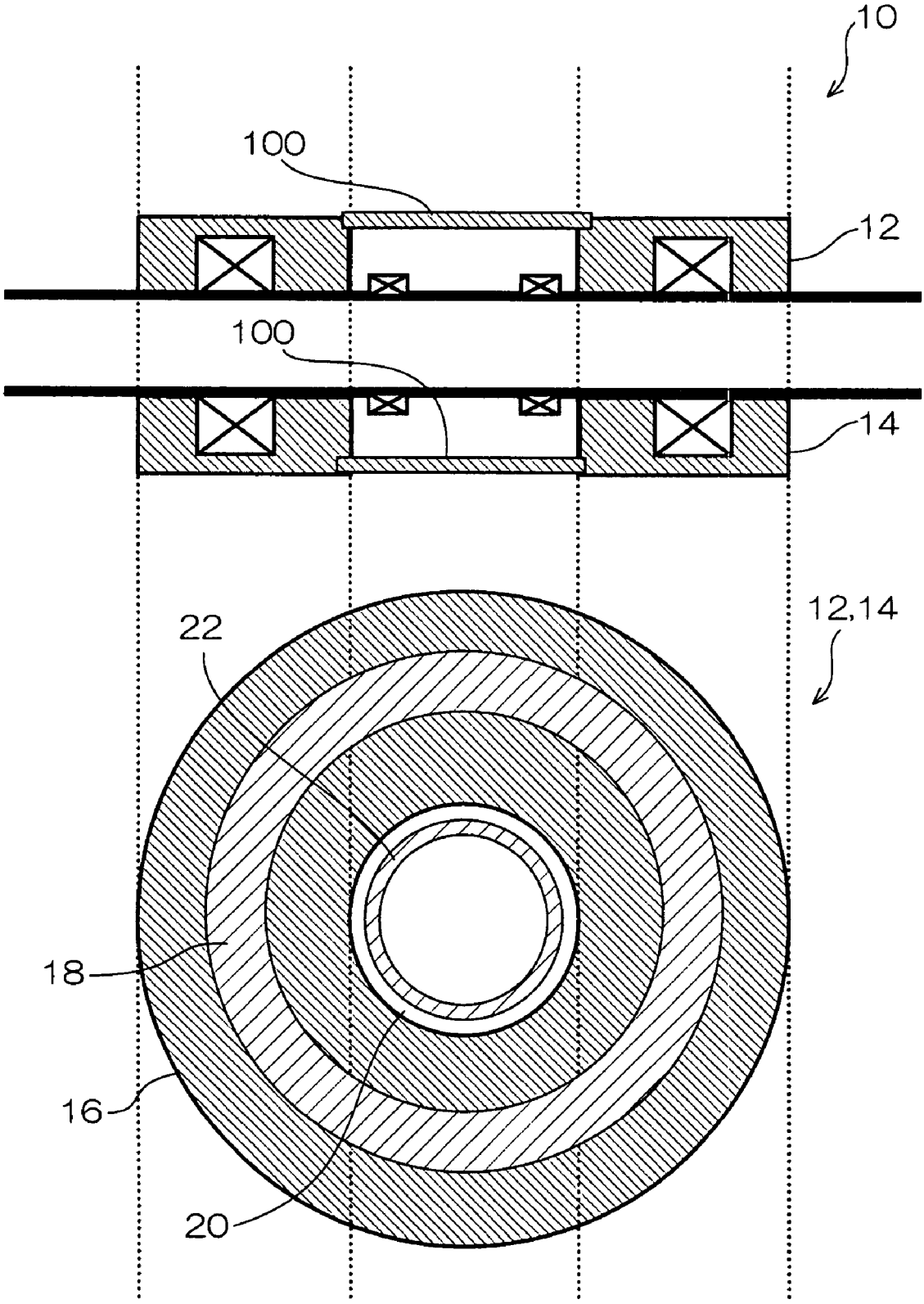
FIG. 7 illustrates a modified example of the antenna according to an embodiment of the invention.

A modified example of the antenna 10 according to the exemplary embodiment is described below with reference to FIG. 7.

In the modified example, a structure is used in which surfaces opposite to the facing surfaces of the transmission side core 12 and the reception side core 14 are covered on non-transmission side with a sheet 100 formed of a ferromagnetic material such as ferrite. The sheet 100 absorbs unwanted electromagnetic waves generated from the antenna 10 so as to suppress unwanted electromagnetic waves from being radiated to environment.

The sheet 100 is provided so as to cover at least the data coils 22. By so doing, it is at least possible to suppress radiation of electromagnetic waves having a high frequency from the data coil 22.

While the present invention has been illustrated and described with respect to a specific exemplary embodiment thereof, it is to be understood that the prevent invention is by no means limited thereto and encompasses all changes and modifications which will become possible within the scope of the appended claims.

What is claimed is:

1. A non-contact signal transmission apparatus that transmits electric power and a signal in a non-contact manner via electromagnetic induction, the apparatus comprising:

a pair of annular electric power cores provided in opposing relationship to each other;

a pair of electric power coils respectively provided in an annular form in one of the pair of electric power cores; and a pair of signal coils respectively provided in an annular form inside one of the pair of electric power cores, wherein relative permeability inside and around the signal coils is lower than relative permeability of the electric power cores.

2. The non-contact signal transmission apparatus according to claim 1, wherein the relative permeability inside and around the signal coils is less than 1/10 of the relative permeability of the electric power cores.

3. The non-contact signal transmission device according to claim 1, wherein inductance of the pair of signal coils is less than an upper limit value $L_{max}$ of inductance obtained according to following formula (1):

$$L_{max}=50/f \quad \text{Formula (1)}$$

wherein, in Formula (1), $L_{max}$ is the upper limit value of the inductance (unit: μH) and f is a frequency of a signal (unit: MHz).

4. The non-contact signal transmission apparatus according to claim 2, wherein inductance of the pair of signal coils is less than an upper limit value $L_{max}$ of inductance obtained according to following formula (1):

$$L_{max}=50/f \quad \text{Formula (1)}$$

wherein, in Formula (1), $L_{max}$ is the upper limit value of the inductance (unit: μH) and f is a frequency of a signal (unit: MHz).

5. The non-contact signal transmission apparatus according to claim 1, further comprising:

signal cores having relative permeability lower than relative permeability of the electric power cores, wherein the signal coils are provided in an annular form at the signal cores.

6. The non-contact signal transmission apparatus according to claim 2, further comprising:

signal cores having relative permeability lower than that of relative permeability of electric power cores, wherein the signal coils are provided in an annular form at the signal cores.

7. The non-contact signal transmission apparatus according to claim 3, further comprising:

signal cores having relative permeability lower than that of relative permeability of electric power cores, wherein the signal coils are provided in an annular form at the signal cores.

8. The non-contact signal transmission apparatus according to claim 1, further comprising a member that is made of a magnetic material and at least partially covers surfaces of the pair of signal coils opposite to opposed surfaces thereof.

9. The non-contact signal transmission apparatus according to claim 2, further comprising a member that is made of a magnetic material and at least partially covers surfaces of the pair of signal coils opposite to opposed surfaces thereof.

10. The non-contact signal transmission apparatus according to claim 3, further comprising a member that is made of a magnetic material and at least partially covers surfaces of the pair of signal coils opposite to opposed surfaces thereof.

11. The non-contact signal transmission apparatus according to claim 5, further comprising a member that is made of a magnetic material and at least partially covers surfaces of the pair of signal coils opposite to opposed surfaces thereof.

12. A non-contact signal transmission apparatus that transmits electric power and a signal in a non-contact manner via electromagnetic induction, the apparatus comprising:

a pair of annular electric power cores provided in opposing relationship to each other;

a pair of electric power coils respectively provided in an annular form in one of the pair of electric power cores; and a pair of signal coils respectively provided in an annular form inside one of the pair of electric power cores, wherein relative permeability inside and around the signal coils is lower than relative permeability of the electric power cores, the relative permeability inside and around the signal coils is less than 1/10 of the relative permeability of the electric power cores, and inductance of the pair of signal coils is less than an upper limit value $L_{max}$ of inductance obtained according to following formula (1):

$$L_{max}=50/f \quad \text{Formula (1)}$$

wherein, in Formula (1), $L_{max}$ is the upper limit value of the inductance (unit: μH), and f is a frequency of a signal (unit: MHz), the apparatus further comprising:

signal cores having relative permeability lower than relative permeability of the electric power cores, wherein the signal coils are provided in an annular form at the signal cores; and a member that is made of a magnetic material and at least partially covers surfaces of the pair of signal coils opposite to opposed surfaces thereof.

* * * * *